US005554009A

United States Patent [19]

Ohta et al.

[11] Patent Number: 5,554,009

[45] Date of Patent: Sep. 10, 1996

[54] SWASH-PLATE HYDRAULIC PRESSURE DEVICE

[75] Inventors: Naoki Ohta; Naoki Kamide; Jun Iwamoto; Yasunobu Kawakami; Tsutomu Hayashi, all of Wako, Japan

[73] Assignee: Honda Giken Kogyo Kabushiki Kaisha, Tokyo, Japan

[21] Appl. No.: 322,865

[22] Filed: Oct. 11, 1994

[30] Foreign Application Priority Data

Oct. 13, 1993 [JP] Japan ..... 5-255431
Oct. 15, 1993 [JP] Japan ..... 5-257978

[51] Int. Cl.[6] ..... F04B 1/14

[52] U.S. Cl. ..... 417/269; 92/129; 92/248

[58] Field of Search ..... 417/269; 91/499; 92/71, 129, 248; 74/579 R, 606 R

[56] References Cited

U.S. PATENT DOCUMENTS

| | | | |
|---|---|---|---|
| 4,583,425 | 4/1986 | Mann et al. | 91/499 |
| 4,741,251 | 5/1988 | Hayashi et al. | 91/499 |
| 5,038,673 | 8/1991 | Shultze | 91/499 |

FOREIGN PATENT DOCUMENTS

| | | |
|---|---|---|
| 484762A1 | 5/1992 | European Pat. Off. . |
| 3627652 | 3/1987 | Germany . |
| 58-172478 | 11/1983 | Japan . |
| 62-104616 | 5/1987 | Japan . |
| 05044813 | 2/1993 | Japan . |
| 924768 | 5/1963 | United Kingdom . |
| 8803227 | 5/1988 | WIPO . |

OTHER PUBLICATIONS

Communication—Search Report.
English Language Translation of Abstract of JP 62–104616.
English language Translation of Abstract of JP 05–044813.
English language Translation of Abstract of JP 58172478.

*Primary Examiner*—Charles Freay
*Attorney, Agent, or Firm*—Lyon & Lyon

[57] ABSTRACT

A swash-plate hydraulic pressure device for use as a hydraulic pump or motor includes a cylinder block having an annular array of cylinder holes defined therein around an axis. A plurality of plungers of a ceramic material are reciprocally movably disposed in the cylinder holes, respectively, the plungers having respective partly spherical tip ends. A swash plate of metal is disposed around the cylinder block for rotation with respect to the cylinder block, the swash plate having a annular groove of a partly spherical cross section defined therein and, the partly spherical tip ends of the plungers engaging in the groove. The tip ends of the plungers preferably have a pore area percentage of at most 7.8% and a maximum surface roughness of at most 1.6 s. The partly spherical tip end of each of the plungers has a radius $R_0$ of curvature, each of the plungers has a diameter D, the groove has a radius $R_1$ of curvature and a depth E. The ratios $R_0/D$, $R_0/R_1$, and $E/R_0$ preferably are in the ranges of $0.52 \leqq R_0/D \leqq 0.62$, $0.81 \leqq R_0/R_1 \leqq 0.87$, and $0.36 \leqq E/R_0 \leqq 0.42$. Each of the plungers has a beveled surface on an end thereof opposite to the partly spherical tip end thereof, the beveled or rounded surface preferably having an axial depth of at least 0.6 mm.

26 Claims, 4 Drawing Sheets

SWASH-PLATE HYDRAULIC PRESSURE DEVICE

BACKGROUND OF THE INVENTION

1. Field of the Invention

The present invention relates to a swash-plate hydraulic pressure device such as a hydraulic pump or a hydraulic motor, and more particularly to a swash-plate hydraulic pressure device having improved plungers and swash plate.

2. Description of the Prior Art

One known swash-plate hydraulic pressure device is disclosed in Japanese patent application No. 3-199621 for example. The swash-plate hydraulic pressure device, which may be used as a hydraulic pump or a hydraulic motor includes a cylinder block having an annular array of cylinder holes defined therein around an axis and held in communication with an oil passage, and a plurality of plungers reciprocally movably disposed in the cylinder holes, respectively. A swash plate rotatable relatively to the cylinder block is disposed in surrounding relation to the cylinder block. The swash plate has an annular array of partly spherical recesses defined therein and held in abutment against respective partly spherical tip ends of the plungers.

When the swash plate is rotated with respect to the cylinder block, the plungers are caused to move reciprocally in the respective cylinder holes for drawing and discharging working oil into and out of the cylinder holes. At this time, the swash-plate hydraulic pressure device operates as a hydraulic pump. Alternatively, working oil is introduced into and discharged out of the cylinder holes to move the plungers reciprocally in the respective cylinder holes, forcing the swash plate to rotate with respect to the cylinder block. At this time, the swash-plate hydraulic pressure device operates as a hydraulic motor.

Heretofore, both the plungers and the swash plate have been made of steel. Under rigorous operating conditions, e.g., when the swash-plate hydraulic pressure device rotates at a high speed or under a high hydraulic pressure, however, the steel plungers tend to wear rapidly.

Japanese laid-open patent publication No. 62-104616 discloses a guide roller for rolling a wire rod of metal, which is an entirely unrelated art but the disclosed guide roller is made of a ceramic material which is highly resistant to wear and heat, and highly lubricatable. Specifically, the disclosed guide roller is made of or surfaced with silicon nitride having a porosity of 1% or less and a surface roughness of 6 s or lower.

However, the specifications of the ceramic material disclosed in that Japanese patent publication cannot be directly applied for use on the plungers of the swashplate hydraulic pressure devices. Specifically, since the plungers are subject to a much higher pressure than the disclosed guide roller, if the maximum surface roughness (Rmax) of the plungers was 6 s, then the oil film would be broken between the tip ends of the plungers and the swash plate, resulting in direct contact between the plungers and the swash plate and hence a localized increase in the pressure between the plungers and the swash plate. Further, the porosity of a ceramic material, which is the ratio of the volume of pores of the material to the volume of the material, is not necessarily an exact representation of the conditions of the contacting surfaces of the plungers and the swash plate.

Another problem is that because the elastic coefficient and coefficient of friction of the ceramic material is different from those of the steel, ceramic plungers would suffer abnormal wear and seizure and be liable to jump out of the recesses of the swash plate in high-speed and high-pressure operation if the ceramic plungers were of the same dimensions and shape as the steel plungers.

SUMMARY OF THE INVENTION

It is therefore an object of the present invention to provide a swash-plate hydraulic pressure device which has plungers of a ceramic material that are effective to reduce wear on or damage to a swash plate, highly resistant to wear and scoring, and are prevented from jumping out of a dimple defined in the swash plate.

According to the present invention, there is provided a swash-plate hydraulic pressure device comprising a cylinder block having an annular array of cylinder holes defined therein around an axis and suction and discharge oil passages defined therein, valve means for selectively bringing the suction and discharge oil passages into communication with the cylinder holes, a plurality of plungers reciprocally movably disposed in the cylinder holes, respectively, the plungers having respective tip ends, and a swash plate disposed around the cylinder block for rotation with respect to the cylinder block, the tip ends of the plungers being held against the swash plate, the swash plate being made of metal, at least the tip ends of the plungers being made of a ceramic material and having a pore area percentage of at most 7.8% and a maximum surface roughness of at most 1.6 s. Preferably, the pore area percentage is of at most 3.21%, and the maximum surface roughness is of at most 1.2 s.

According to the present invention, there is also provided a swash-plate hydraulic pressure device comprising a cylinder block having an annular array of cylinder holes defined therein around an axis and suction and discharge oil passages defined therein, valve means for selectively bringing the suction and discharge oil passages into communication with the cylinder holes, a plurality of plungers of a ceramic material reciprocally movably disposed in the cylinder holes, respectively, the plungers having respective partly spherical tip ends and a swash plate of metal disposed around the cylinder block for rotation with respect to the cylinder block, the swash plate having a groove of a partly spherical cross section defined therein, the partly spherical tip ends of the plungers engaging in the groove, the partly spherical tip end of each of the plungers having a radius $R_0$ of curvature, and each of the plungers having a diameter D, the ratio of the radius $R_0$ of curvature of the diameter D being in the range of $0.52 \leqq R_0/D \leqq 0.62$. Preferably, the ratio is in the range of $0.55 \leqq R_0/D \leqq 0.60$.

According to the present invention, there is further provided a swash-plate hydraulic pressure device comprising a cylinder block having an annular array of cylinder holes defined therein around an axis and suction and discharge oil passages defined therein, valve means for selectively bringing the suction and discharge oil passages into communication with the cylinder holes, a plurality of plungers of a ceramic material reciprocally movably disposed in the cylinder holes, respectively, the plungers having respective partly spherical tip ends, and a swash plate of metal disposed around the cylinder block for rotation with respect to the cylinder block, the swash plate having a groove of a partly spherical cross section defined therein, the partly spherical tip ends of the plungers engaging in the groove, the partly spherical tip end of each of the plungers having a radius $R_0$ of curvature, and the groove having a radius $R_1$ of curvature, the ratio of the radius $R_0$ of curvature to the radius $R_1$ of curvature being in the range of $0.81 \leqq R_0/R_1 \leqq 0.87$.

According to the present invention, there is also provided a swash-plate hydraulic pressure device comprising a cylinder block having an annular array of cylinder holes defined therein around an axis and suction and discharge oil passages defined therein, valve means for selectively bringing the suction and discharge oil passages into communication with the cylinder holes, a plurality of plungers of a ceramic material reciprocally movably disposed in the cylinder holes, respectively, the plungers having respective partly spheric a tip ends, and a swash plate of metal disposed around the cylinder block for rotation with respect to the cylinder block, the swash plate having a groove of a partly spherical cross section defined therein, the partly spherical tip ends of the plungers engaging in the groove, the partly spherical tip end of each of the plungers having a radius $R_0$ of curvature, and the groove having a depth E, the ratio of the depth E to the radius $R_0$ of curvature being in the range of $0.36 \leqq E/R_0 \leqq 0.42$.

According to the present invention, there is also provided a swash-plate hydraulic pressure device comprising a cylinder block having an annular array of cylinder holes defined therein around an axis and suction and discharge oil passages defined therein, valve means for selectively bringing the suction and discharge oil passages into communication with the cylinder holes, a plurality of plungers of a ceramic material reciprocally movably disposed in the cylinder holes, respectively, the plungers having respective partly spherical tip ends, and a swash plate of metal disposed around the cylinder block for rotation with respect to the cylinder block, the swash plate having a groove of a partly spherical cross section defined therein, the partly spherical tip ends of the plungers engaging in the groove, each of the plungers having a beveled surface on an end thereof opposite to the partly spherical tip end thereof, the beveled surface having an axial depth of at least 0.6 mm.

According to the present invention, there is further provided a swash-plate hydraulic pressure device comprising a cylinder block having an annular array of cylinder holes defined therein around an axis and suction and discharge oil passages defined therein, valve means for selectively bringing the suction and discharge oil passages into communication with the cylinder holes, a plurality of plungers of a ceramic material reciprocally movably disposed in the cylinder holes, respectively, the plungers having respective partly spherical tip ends, and a swash plate of metal disposed around the cylinder block for rotation with respect to the cylinder block, the swash plate having a groove of a partly spherical cross section defined therein, the partly spherical tip ends of the plungers engaging in the groove, each of the plungers having a rounded surface on an end thereof opposite to the partly spherical tip end thereof, the rounded surface having an axial depth of at least 0.6 mm.

According to the present invention, there is also provided a swash-plate hydraulic pressure device comprising a cylinder block having an annular array of cylinder holes defined therein around an axis and suction and discharge oil passages defined therein, valve means for selectively bringing the suction and discharge oil passages into communication with the cylinder holes, a plurality of plungers of a ceramic material reciprocally movably disposed in the cylinder holes, respectively, the plungers having respective partly spherical tip ends, and a swash plate of metal disposed around the cylinder block for rotation with respect to the cylinder block, the swash plate having a groove of a partly spherical cross section defined therein, the partly spherical tip ends of the plungers engaging in the groove, each of the plungers having a pair of shoulders near an end thereof opposite to the partly spherical tip end thereof. Each of the shoulders may be round or double-stepped, and may have a radial of at least 0.5 mm from an outer diameter of the plunger.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
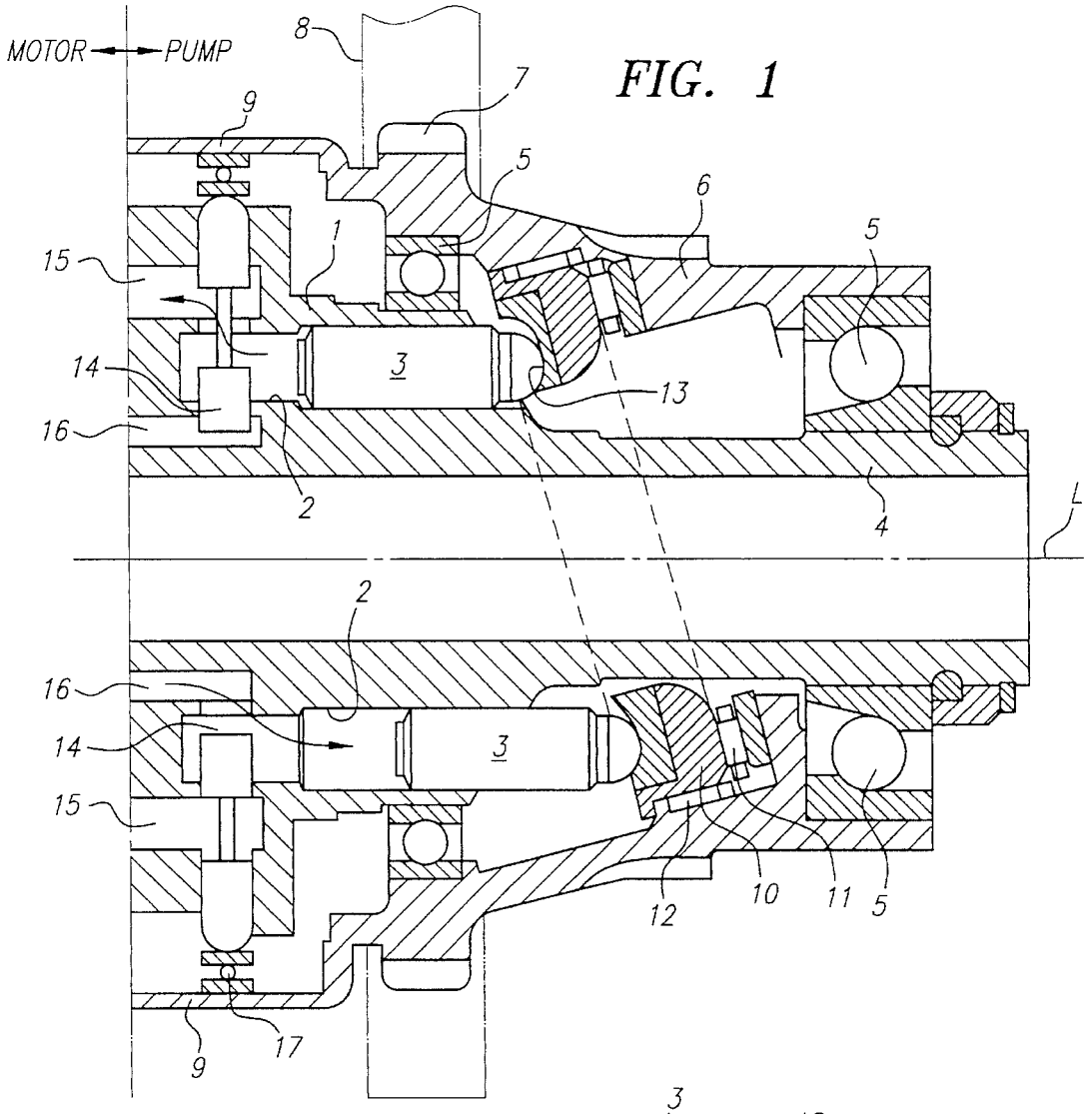
FIG. 1 is a cross-sectional view of a swash-plate hydraulic pressure device according to the present invention, with the swash-plate hydraulic pressure device being used as a hydraulic pump in a hydrostatic continuously variable transmission on a motorcycle or other vehicle.

As shown in FIG. 1, a swash-plate hydraulic pressure device according to the present invention is used as a hydraulic pump in a hydrostatic continuously variable transmission on a motorcycle, for example, and the other half (to the left of the vertical line in FIG. 1) of the hydrostatic continuously variable transmission is similar but functions as a variable volume motor.

The swash-plate hydraulic pressure device comprises a cylinder block 1 having an annular array of cylinder holes 2 defined therein at equal angular intervals around and parallel to an axis L, and a like plurality of plungers 3 reciprocally movably disposed in the cylinder holes 2, respectively. The plungers 3 are made of a ceramic material composed primarily of silicon nitride ($Si_3N_4$) or the like. Alternatively, only the tip ends of the plungers 3 may be made of a ceramic material, such as silicon nitride or the like, and attached to a plunger base of any convenient material.

The cylinder block 1 has a hollow shaft 4 extending away from the cylinder holes 2 coaxially with the axis L. The swash-plate hydraulic pressure device also includes a hollow rotor 6 rotatably supported on the cylinder block 1 and the shaft 4 by plural bearings 5. The rotor 6 has a sprocket 7 disposed on an axially intermediate outer circumferential surface thereof. A chain 8 is trained around the sprocket 7 and the crankshaft (not shown) of the engine of the motorcycle for causing rotation of the rotor 6. The rotor 6 has an eccentric ring end portion 9 disposed around the cylinder holes 2 in eccentric relation to the axis L.

A swash plate 10 is rotatably supported on an axially intermediate inner circumferential surface of the rotor 6 by a thrust bearing 11 and a radial bearing 12. The swash plate 10 is made of steel (such as SUJ2 HRC60~65) having a surface roughness of 3.2 s. The swash plate 10 is disposed around the shaft 4 and has its plane tilted with respect to the axis L. The swash plate 10 has an annular groove 13 of a partly spherical cross section defined in an axial surface thereof and held in abutment against partly spherical tip ends of the plungers 3. In the case when operating conditions are not so rigorous, the groove 13 is not always necessary and a swash plate 10 may have a flat surface engaging spherical tip ends of the plungers. Further, a plurality of dimples may be provided in the axial surface of the swash plate 10 rather than a groove 13 with a plunger 3 engaging each dimple.

The cylinder holes 2 define respective oil chambers therein which are held in selective communication with a discharge oil passage 15 or a suction oil passage 16 defined in the cylinder block 1 through valves 14. The valves 14 are normally urged radially outwardly by springs (not shown), and have respective radially outer ends held against a bearing 17 which is in turn mounted on an inner circumferential surface of the eccentric ring end portion 9.

When the motorcycle engine operates, the rotor 6 is rotated about the axis L, which causes pivoting of the swash plate 10 relative to the axis L and may cause rotating of the swash plate 10 around the shaft 4. As the swash plate 10 pivots and rotates, those of the plungers 3 which are in a discharge region, i.e., the upper plungers 3 in FIG. 1, are moved to the left, compressing the oil chambers. At this time, the valves 14 associated with the plungers 3 in the discharge region are pushed downwardly (radially inwardly) by the eccentric ring end portion 9. The oil chambers in the cylinder holes 2 which accommodate the plungers 3 in the discharge region are now brought into communication with the discharge oil passage 15, allowing oil to be discharged from the oil chambers into the discharge oil passage 15, as shown by the upper arrow.

The valves 14 associated with the plungers 3 in the suction region are pushed downwardly (radialy outwardly) by the springs (not shown) with that movement being controlled by the eccentric ring end portion 9. The oil chambers in the cylinder holes 2 which accommodate the plungers 3 in the suction region are now brought into communication with the suction oil passage 16, allowing oil to be drawn from the suction oil passage 16 into the oil chambers, as shown by the lower arrow. The introduced oil displaces those plungers 3 which are in the suction region, i.e., the lower plungers 3 in FIG. 1, to the right while being held in contact with the swash plate 10.

The hydrostatic continuously variable transmission includes another swash-plate hydraulic pressure device (to the left of the long dash and short dash line in FIG. 1 and not shown) in the form of a hydraulic motor which can be actuated by the hydraulic pump shown in FIG. 1. The hydraulic motor is provided in a leftward extension of the hydraulic pump and comprises an annular array of plungers reciprocally disposed in respective cylinder holes defined in a leftward extension of the cylinder block 1, and a variable-angle swash plate rotatably supported in a leftward extension of the rotor 6. Oil chambers defined in the cylinder holes of the hydraulic motor are held in communication with the oil chambers defined in the cylinder holes 2 of the hydraulic pump through the discharge oil passage 15 and the suction oil passage 16.

The oil discharged from the hydraulic pump through the discharge oil passage 15 flows into the cylinder holes of the hydraulic motor, projecting those plungers which are in an expansion region. The projected plungers rotate the swash plate of the hydraulic motor. As the swash plate of the hydraulic motor rotates, those plungers of the hydraulic motor which are in a contraction region are retracted, forcing oil to flow out of the corresponding cylinder holes through the suction oil passage 16 into the cylinder holes 2 which accommodate the plungers 3 in the suction region.

The cylinder block 1 is now rotated under the sum of a reactive torque received from the swash plate 10 of the hydraulic pump and a reactive torque received from the swash plate of the hydraulic motor. When the angle of the swash plate of the hydraulic motor is varied, the reactive torque received from the swash plate of the hydraulic motor is varied for thereby varying the rotational speed of the cylinder block 1. Therefore, the hydrostatic continuously variable transmission can continuously vary the speed reduction ratio.

Figure 2:
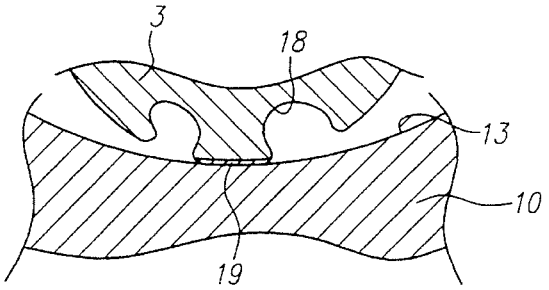
FIG. 2 is an enlarged fragmentary cross-sectional view showing a region in which a plunger and a swash plate contact each other.

As shown in FIG. 2, the partly spherical tip end of each of the plungers 3, which are made of a ceramic material composed primarily of silicon nitride ($Si_3N_4$) or the like, has a number of pores 18 in its surface contacting the surface of the groove 13, and an oil film 19 is interposed between the surface of the partly spherical tip of the plunger 3 and the surface of the dimple 13.

Figure 3:
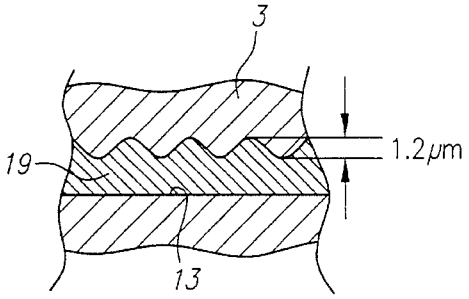
FIG. 3 is an enlarged fragmentary cross-sectional view of the region shown in FIG. 2.

The pores 18 in the surface of the partly spherical tip of the plunger 3 which contacts the surface of the groove 13 have a pore area percentage of 7.8% or less, preferably 3.21% or less, for reasons discussed below. As shown in enlarged FIG. 3, the surface of the partly spherical tip of the plunger 3 which contacts the surface of the groove 13 has a maximum surface roughness (Rmax) of 1.6 s or less, preferably 1.2 s or less, for reasons discussed below. If the pore area percentage exceeded 7.8% and the maximum surface roughness (Rmax) exceeded 1.6 s, then tests have shown that the surface of the groove 13 in the swash plate 10 would wear too rapidly, as can be seen from FIG. 4. Each of the pores 18 should have a size of 50 μ or less because larger pores would reduce the mechanical strength of the surface of the plunger 3.

Figure 4:
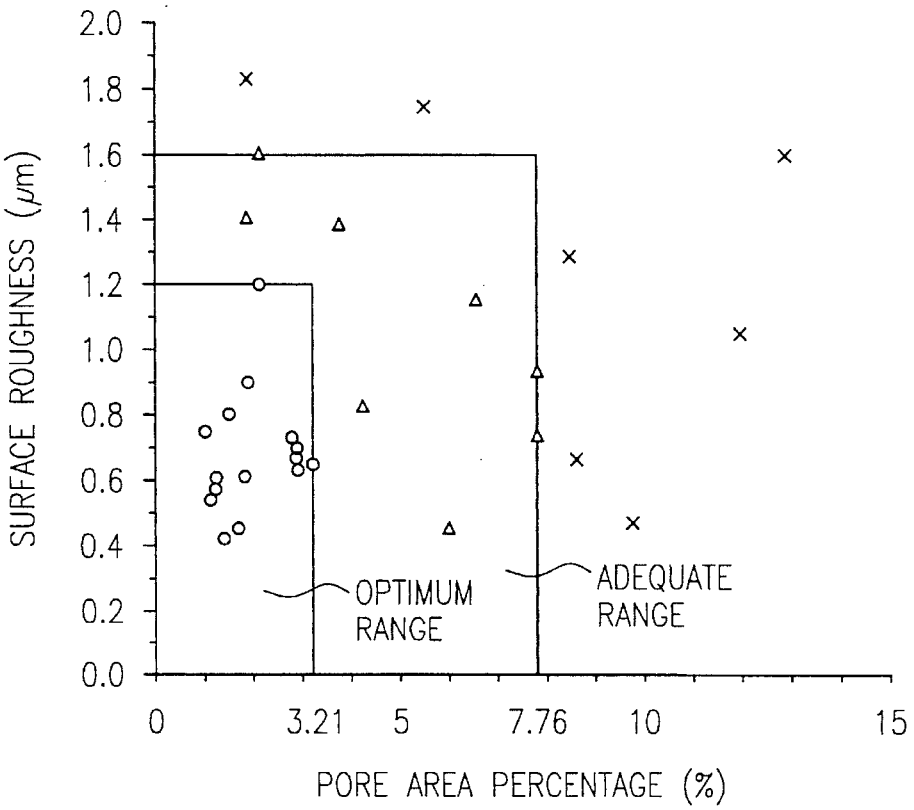
FIG. 4 is a graph showing examples of certain ranges of surface roughnesses and pore area percentages of plungers.

FIG. 4 shows examples of certain ranges of surface roughnesses and pore area percentages of plungers. The data in the graph shown in FIG. 4 was obtained from a durability test of plungers in which the swash-plate hydraulic pressure device was rotated at 3,600 rpm under a hydraulic pressure of 450 kg/cm$^2$ for 20 hours. In the durability test, the plungers were subjected to a pressure of 200 kg/mm$^2$ and a peripheral speed of 0.01 m/s. In FIG. 4, those marked with ○ indicate plungers which cleared the durability test, those marked with Δ indicate plungers which cleared the durability test, but exhibited wear, and those marked with X indicate plungers which did not clear the durability test because of excessive wear.

Figure 5:
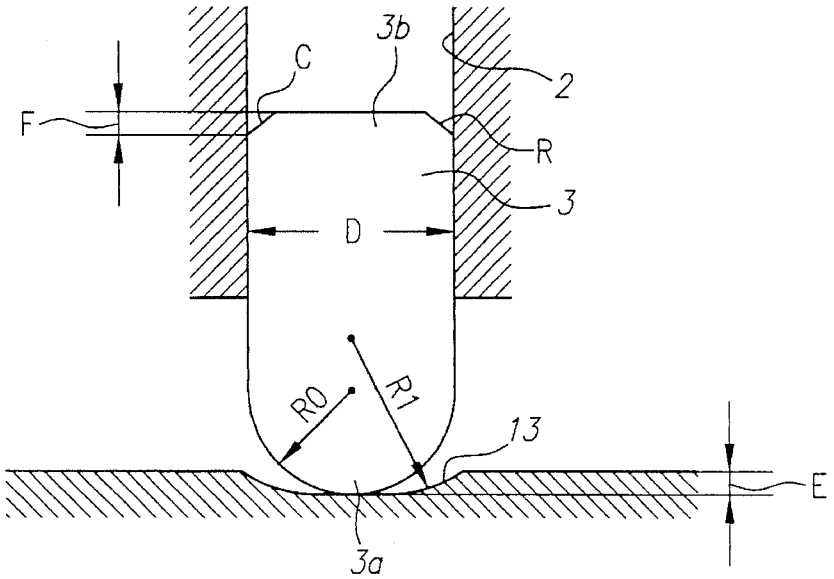
FIG. 5 is an enlarged fragmentary cross-sectional view showing another region in which a plunger and a swash plate contact each other.

As shown in FIG. 5, the partly spherical tip end, denoted at 3*a*, of each of the plungers 3 which is reciprocally movably disposed in the corresponding cylinder hole 2 is held against the surface of the groove 13. The plunger 3 has a diameter of D, and the plunger tip end 3*a* has a radius $R_0$ of curvature. The surface of the groove 13 has a radius $R_1$ of curvature and a depth E.

Figure 6:
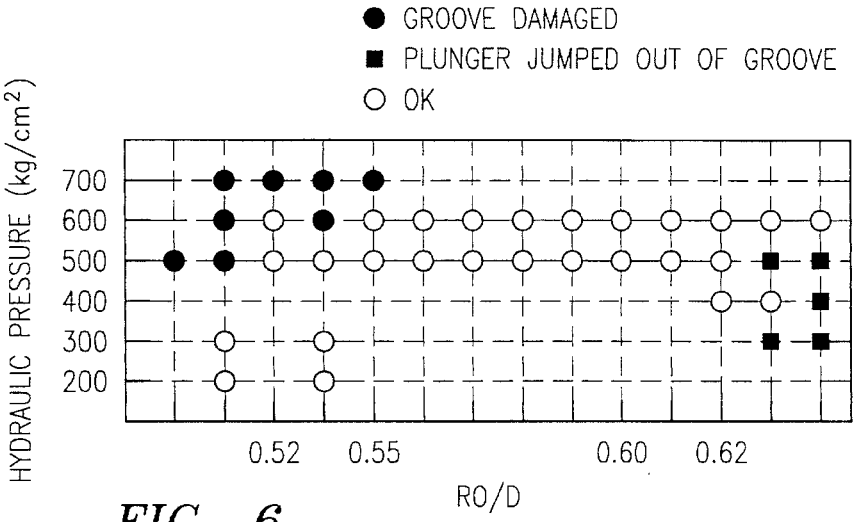
FIG. 6 is a graph showing the relationship between a ratio $R_0/D$ and a hydraulic pressure as that relationship effects dimple damage and plunger jumping.

FIG. 6 shows the relationship between a ratio $R_0/D$ and a hydraulic pressure acting on the plunger 3, as that relationship effects damage to the groove 13 and jumping of the plunger 3 out of the groove 13 when the plunger 3 rotates with respect to the swash plate 10 at 3,600 rpm. As can be seen from FIG. 6, if the ratio $R_0/D$ were smaller than 0.52, then the groove 13 would be cracked or otherwise damaged. This is because if the ratio $R_0/D$ were smaller than 0.52, then the plunger 3 would be more pointed and contact the groove 13 under an increased pressure, and the introduction of oil between the partly spherical tip end 3*a* and the groove 13 would become intermittent, causing the partly spherical tip end 3*a* to wear the groove 13, at least at high hydraulic pressures as shown by the solid round dots in FIG. 6. If the ratio $R_0/D$ were greater than 0.62, then the partly spherical tip end 3*a* would tend to jump out of the groove 13, as shown by the solid squares in FIG. 6. This is because if the ratio $R_0/D$ were greater than 0.62, the point of contact between the partly spherical tip end 3*a* and the groove 13 would be shifted radially outwardly from the center of the plunger 3. Therefore, the ratio $R_0/D$ should be in the range of $0.52 \leqq R_0/D \leqq 0.62$, and preferably in the range of $0.55 \leqq R_0/D \leqq 0.60$, as shown by the empty round dots in FIG. 6.

Figure 7:
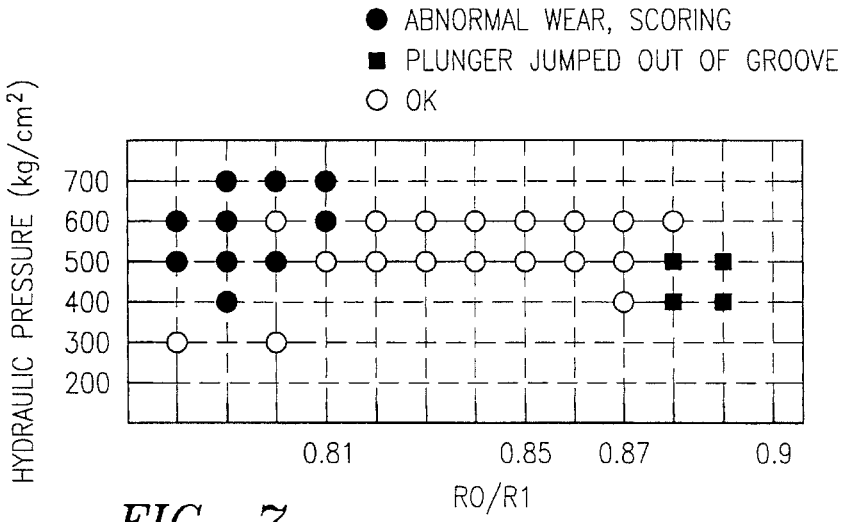
FIG. 7 is a graph showing the relationship between a ratio $R_0/R_1$ and the hydraulic pressure as that relationship effects abnormal wear and plunger jumping.

FIG. 7 shows the relationship between a ratio $R_0/R_1$ and the hydraulic pressure acting on the plunger 3, as that relationship effects abnormal wear on the plunger 3 and jumping of the plunger 3 out of the groove 13 when the plunger 3 rotates with respect to the swash plate 10 at 3,600 rpm. It can be seen from FIG. 7 that if the ratio $R_0/R_1$ was smaller than 0.81, then the plunger 3 would suffer abnormal wear and scoring (solid round dots), and if the ratio $R_0/R_1$ was greater than 0.87 (solid squares), then the partly spherical tip end 3*a* of the plunger 3 would jump out of the groove 13, for the reasons described above. Therefore, the ratio $R_0/R_1$ should be in the range of $0.81 \leqq R_0/R_1 \leqq 0.87$, as shown by the empty round dots in FIG. 7.

Figure 8:
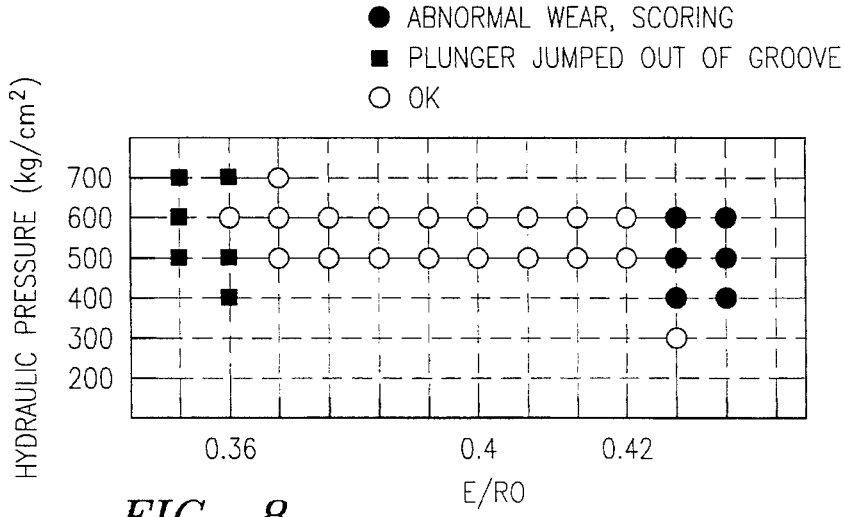
FIG. 8 is a graph showing the relationship between a ratio $R_0/R_1$ and the hydraulic pressure as that relationship effects abnormal wear and plunger jumping.

FIG. 8 shows the relationship between a ratio $E/R_0$ and the hydraulic pressure acting on the plunger 3, as that relationship effects abnormal wear on the plunger 3 and jumping of the plunger 3 out of the groove 13 when the plunger 3 rotates with respect to the swash plate 10 at 3,600 rpm. The graph shown in FIG. 8 indicates that if the ratio $E/R_0$ was smaller than 0.36, then the partly spherical tip end 3*a* of the plunger 3 would jump out of the groove 13 (solid squares), and if the ratio $E/R_0$ was greater than 0.42, then the plunger 3 would suffer abnormal wear and scoring (solid round dots). Therefore, the ratio $E/R_0$ should be in the range of $0.36 \leqq E/R_0 \leqq 0.42$, as shown by the empty round dots in FIG. 8.

As shown in FIG. 5, the plunger 3 has an end 3*b* remote from the partly spherical tip end 3*a* inserted in the cylinder hole 2, the end 3*b* being either beveled at a surface C or rounded at a surface R. The beveled or rounded end 3*b* is effective to cause the oil to automatically center the plunger 3 in the cylinder hole 2, so that oil film between the inner circumferential surface of the cylinder hole 2 and the outer circumferential surface of the plunger 3 will not be interrupted. Consequently, the plunger 3 is prevented from suffering scoring or wear when it reciprocally moves in the cylinder hole 2. While the end 3*b* is shown as being both beveled at C and rounded at R in FIG. 5, the end 3*b* is actually either beveled or rounded but not both.

Figure 9:
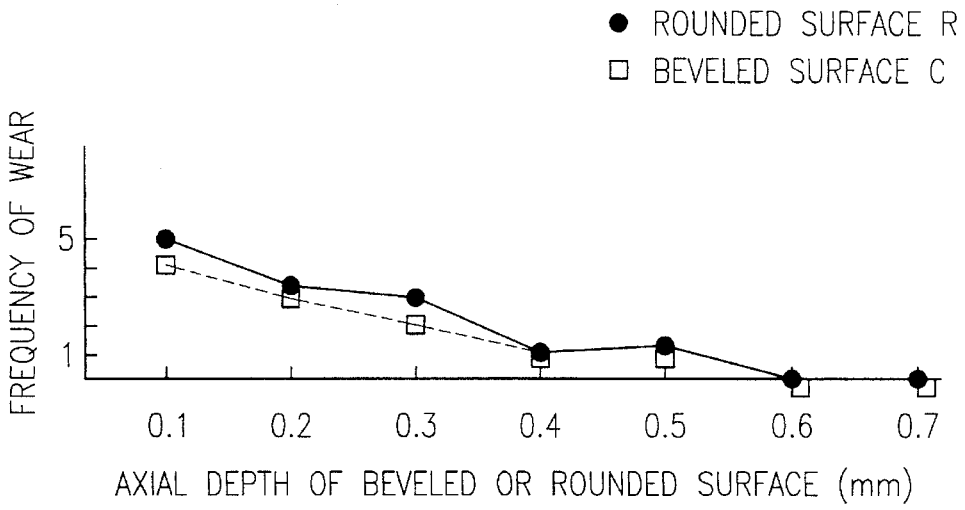
FIG. 9 is a graph showing the relationship between the depth of a beveled or rounded surface and the frequency of wear or scoring on the plunger.

FIG. 9 shows the relationship between the axial depth F (see FIG. 5) of the beveled surface C or the rounded surface R and the frequency of wear or scoring when the plunger 3 rotates with respect to the swash plate 10 at 3,600 rpm. A study of FIG. 9 indicates that the axial depth F of the beveled surface C or the rounded surface R should preferably be of 0.6 mm or greater.

Figure 10:
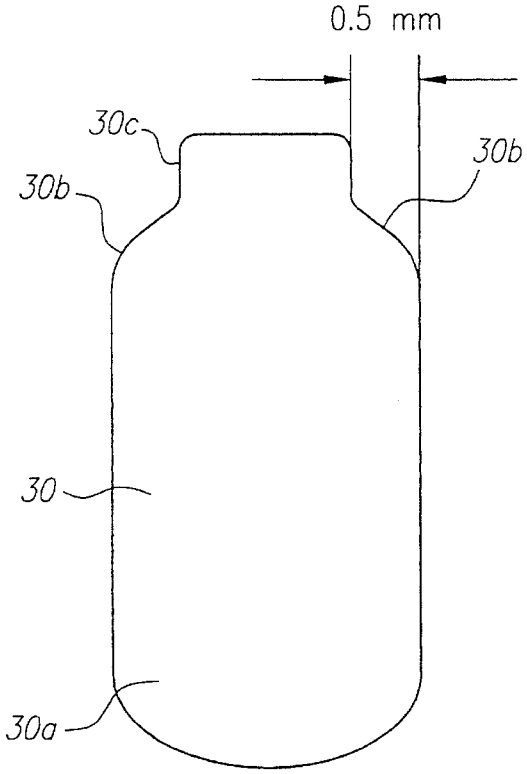
FIG. 10 is an elevational view of a plunger according to a modification of the present invention.

FIG. 10 shows a plunger 30 according to a modification of the present invention. The plunger 30 has a partly spherical tip end 30*a* and has a pair of round shoulders 30*b* near an opposite end thereof. Each of the round shoulders 30*b* has a radial depth of at least 0.5 mm resulting in a upper shank 30*c* of a diameter 1.0 mm or more smaller than an outer diameter of plunger 30.

Figure 11:
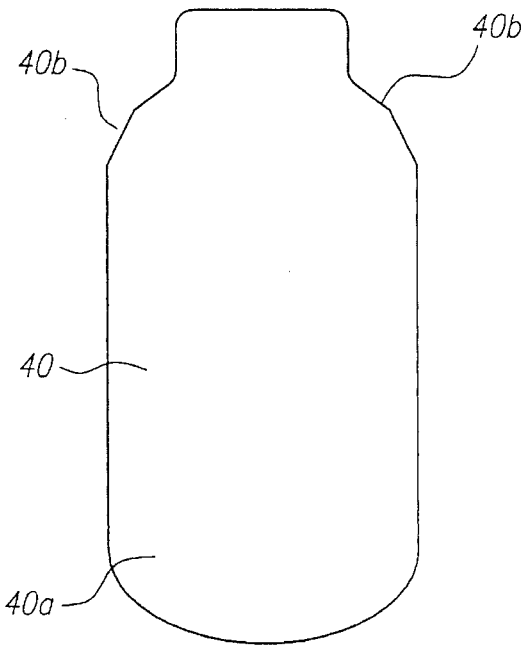
FIG. 11 is an elevational view of a plunger according to another modification of the present invention.

FIG. 11 shows a plunger 40 according to another modification of the present invention. The plunger 40 has a partly spherical tip end 40*a* and has a pair of double stepped shoulders 40*b* near an opposite end thereof, similar to rounded shoulder 30*b* of plunger 30.

Each of the plungers 30 and 40 shown in FIGS. 10 and 11 will be automatically be centered in the cylinder hole 2 because of the shoulders 30*b* and 40*b*, respectively.

Although certain preferred embodiments and modifications of the present invention have been shown and described in detail, it should be understood that various changes and other modifications may be made therein without departing from the scope of the invention as defined by the appended claims.

What is claimed is:

1. A swash-plate hydraulic pressure device comprising:

a cylinder block having an annular array of cylinder holes around an axis of said cylinder block, said cylinder block having suction and discharge oil passages;

valve means for selectively bringing said suction and discharge oil passages into communication with said cylinder holes;

a plurality of plungers reciprocally movably disposed in said cylinder holes, respectively, each said plunger having a tip end; and a swash plate disposed around said cylinder block for rotation with respect to said cylinder block, said tip end of each said plunger engaging said swash plate;

said swash plate being made of metal, at least said tip end of each of said plungers being made of a ceramic material having a pore area percentage of at most 7.8% and a maximum surface roughness of at most 1.6 s.

2. A swash-plate hydraulic pressure device according to claim 1, wherein said pore area percentage is of at most 3.21%, and said maximum surface roughness is of at most 1.2 s.

3. A swash platte hydraulic pressure device according to claim 1, wherein said swash plate has a annular groove of a partly spherical cross section, said tip ends of said plungers engaging said groove, said tip end of each said plunger is partly spherical with a radius $R_0$ of curvature, each said plunger has a diameter of D, and a ratio of said radius $R_0$ of curvature to said diameter D is in a range of $0.52 \leqq R_0/D \leqq 0.62$.

4. A swash plate hydraulic pressure device according to claim 1, wherein said swash plate has an annular groove of a partly spherical cross section, said tip end of each said plunger engaging said groove, said tip end of each said plunger is partly spherical with a radius $R_0$ of curvature, said groove has a radius $R_1$ of curvature, and a ratio of said radius $R_0$ of curvature to said radius $R_1$ of curvature being in a range of $0.81 \leqq R_0/R_1 \leqq 0.87$.

5. A swash plate hydraulic pressure device according to claim 4, wherein said groove has a depth E, and a ratio of said depth E to said radius $R_0$ of curvature being in a range of $0.36 \leqq E/R_0 \leqq 0.42$.

6. A swash plate hydraulic pressure device according to claim 1, wherein said swash plate has an annular groove of a partly spherical cross section, said tip end of each said plunger engaging said groove, said tip end of each said plunger is partly spherical with a radius $R_0$ of curvature, said groove has a depth E, and a ratio of said radius $R_0$ of curvature to said depth E being in a range of $0.36 \leqq E/R_0 \leqq 0.42$.

7. A swash-plate hydraulic pressure device comprising:

a cylinder block having an annular array of cylinder holes around an axis of said cylinder block, said cylinder block having suction and discharge oil passages;

valve means for selectively bringing said suction and discharge oil passages into communication with said cylinder holes;

a plurality of plungers of a ceramic material reciprocally movably disposed in said cylinder holes, respectively, each said plunger having a partly spherical tip end; and a swash plate of metal disposed around said cylinder block for rotation with respect to said cylinder block, said swash plate having a groove of a partly spherical cross section, said partly spherical tip ends of said plungers engaging said groove;

said partly spherical tip end of each of said plungers having a radius $R_0$ of curvature, each of said plungers having a diameter D, and a ratio of said radius $R_0$ of curvature to said diameter D being in a range of $0.52 \leqq R_0/D \leqq 0.62$.

8. A swash-plate hydraulic pressure device according to claim 7, wherein said ratio is in the range of $0.55 \leqq R_0/D \leqq 0.60$.

9. A swash plate hydraulic pressure device according to claim 7, wherein said groove has a radius $R_1$ of curvature, and a ratio of said radius $R_0$ of curvature to said radius $R_1$ of curvature being in a range of $0.81 \leqq R_0/R_1 \leqq 0.87$.

10. A swash plate hydraulic pressure device according to claim 9, wherein said groove has a depth E, and ratio of said depth E to said radius $R_0$ of curvature being in a range of $0.36 \leqq E/R_0 \leqq 0.42$.

11. A swash plate hydraulic pressure device according to claim 7, wherein said groove has a depth E, and a ratio of said depth E to said radius $R_0$ of curvature being in a range of $0.36 \leqq E/R_0 \leqq 0.42$.

12. A swash-plate hydraulic pressure device comprising:

a cylinder block having an annular array of cylinder holes around an axis of said cylinder block, said cylinder block having suction and discharge oil passages;

valve means for selectively bringing said suction and discharge oil passages into communication with said cylinder holes;

a plurality of plungers of a ceramic material reciprocally movably disposed in said cylinder holes, respectively, each said plunger having a partly spherical tip end;

and a swash plate of metal disposed around said cylinder block for rotation with respect to said cylinder block, said swash plate having a groove of a partly spherical cross section, said partly spherical tip ends of said plungers engaging said groove;

said partly spherical tip end of each of said plungers having a radius $R_0$ of curvature, said groove having a radius $R_1$ of curvature, and a ratio of said radius $R_0$ of curvature to said radius $R_1$ of curvature being in a range of $0.81 \leqq R_0/R_1 \leqq 0.87$.

13. A swash plate hydraulic pressure device according to claim 12, wherein said groove has a depth E, and a ratio of said depth E to said radius $R_0$ of curvature to said depth E being in a range of $0.36 \leqq E/R_0 \leqq 0.42$.

14. A swash-plate hydraulic pressure device comprising:

a cylinder block having an annular array of cylinder holes around an axis of said cylinder block, said cylinder block having suction and discharge oil passages;

valve means for selectively bringing said suction and discharge oil passages into communication with said cylinder holes;

a plurality of plungers of a ceramic material reciprocally movably disposed in said cylinder holes, respectively, each said plungers having a partly spherical tip end; and a swash plate of metal disposed around said cylinder block for rotation with respect to said cylinder block, said swash plate having a groove of a partly spherical cross section, said partly spherical tip ends of said plungers engaging said groove;

said partly spherical tip end of each of said plungers having a radius $R_0$ of curvature, said groove having a depth E, and a ratio, of said depth E to said radius $R_0$ of curvature being in a range of $0.36 \leqq E/R_0 \leqq 0.42$.

15. A swash-plate hydraulic pressure device comprising:

a cylinder block having an annular array of cylinder holes around an axis of said cylinder block, said cylinder block having suction and discharge oil passages;

valve means for selectively bringing said suction and discharge oil passages into communication with said cylinder holes;

a plurality of plungers of a ceramic material reciprocally movably disposed in said cylinder holes, respectively, each said plunger having a partly spherical tip end; and a swash plate of metal disposed around said cylinder block for rotation with respect to said cylinder block, said swash plate having a groove of a partly spherical cross section, said partly spherical tip ends of said plungers engaging said groove;

each of said plungers having a beveled surface on an end of said plunger opposite to said partly spherical tip end, said beveled surface having an axial depth of at least 0.6 mm.

16. A swash-plate hydraulic pressure device comprising:

a cylinder block having an annular array of cylinder holes around an axis of said cylinder block, said cylinder block having suction and discharge oil passages;

valve means for selectively bringing said suction and discharge oil passages into communication with said cylinder holes;

a plurality of plungers of a ceramic material reciprocally movably disposed in said cylinder holes, respectively, each said plunger having a partly spherical tip end; and a swash plate of metal disposed around said cylinder block for rotation with respect to said cylinder block, said swash plate having a groove of a partly spherical cross section, said partly spherical tip ends of said plungers engaging said groove;

each of said plungers having a rounded surface on an end of said plunger opposite to said partly spherical tip end, said rounded surface having an axial depth of at least 0.6 mm.

17. A swash-plate hydraulic pressure device comprising:

a cylinder block having an annular array of cylinder holes around an axis of said cylinder block, said cylinder block having suction and discharge oil passages;

valve means for selectively bringing said suction and discharge oil passages into communication with said cylinder holes;

a plurality of plungers of a ceramic material reciprocally movably disposed in said cylinder holes, respectively, each said plunger having a partly spherical tip end; and a swash plate of metal disposed around said cylinder block for rotation with respect to said cylinder block, said swash plate having a groove of a partly spherical cross section, said partly spherical tip ends of said plungers engaging said groove;

each of said plungers having a round shank portion near an end of said plunger opposite to said partly spherical tip end.

18. A swash-plate hydraulic pressure device according to claim 17, wherein a rounded shoulder extends between said shank portion and an outer cylindrical surface of each said plunger.

19. A swash-plate hydraulic pressure device according to claim 17, wherein a double-stepped shoulder extends between said shank portion and an outer cylindrical surface of each said plunger.

20. A swash-plate hydraulic pressure device according to claim 17, wherein said round shank portion has a radial depth of at least 0.5 mm from an outer diameter of said plunger.

21. A swash plate hydraulic pressure device according to claim 3, wherein said groove has a radius $R_1$ of curvature, and a ratio of said radius $R_0$ of curvature to said radius $R_1$ of curvature being in a range of $0.81 \leqq R_0/R_1 \leqq 0.87$.

22. A swash plate hydraulic pressure device according to claim 21, wherein said groove has a depth E, and a ratio of said depth E to said radius $R_0$ of curvature being in a range of $0.36 \leqq E/R_0 \leqq 0.42$.

23. In a swash-plate hydraulic pressure device having a cylinder block with an annular array of cylinder holes around an axis and suction and discharge oil passages, a plunger reciprocally movably disposed in each cylinder hole, each plunger having a tip end, and a swash plate facing the cylinder block with the tip ends of the plungers engaging the swash plate, an improvement comprising;

at least the tip ends of the plungers having a surface of a ceramic material with a maximum pore area percentage of 7.8% and a maximum surface roughness of 1.6 s.

24. In a swash-plate hydraulic pressure device having a cylinder block with an annular array of cylinder holes around an axis and suction and discharge oil passages, a plunger reciprocally movably disposed in each cylinder hole, and a swash plate facing the cylinder block, an improvement comprising;

the swash plate having a groove of a partly spherical cross section, and each plunger having a partly spherical tip end engaging said groove, said partly spherical tip end of each of said plungers having a radius $R_0$ of curvature, each of said plungers having a diameter D, and a ratio of said radius $R_0$ of curvature to said diameter D being in the range of $0.52 \leqq R_0/D \leqq 0.62$.

25. In a swash-plate hydraulic pressure device having a cylinder block with an annular array of cylinder holes around an axis and suction and discharge oil passages, a plunger reciprocally movably disposed in each cylinder hole, and a swash plate facing the cylinder block, an improvement comprising;

the swash plate having a groove of a partly spherical cross section, and each plunger having a partly spherical tip end engaging said groove, said partly spherical tip end of each of said plungers having a radius $R_0$ of curvature, said groove having a radius $R_1$ of curvature, and a ratio of said radius $R_0$ of curvature to said radius $R_1$ of curvature being in the range of $0.81 \leqq R_0/R_1 \leqq 0.87$.

26. In a swash-plate hydraulic pressure device having a cylinder block with an annular array of cylinder holes around an axis and suction and discharge oil passages, a plunger reciprocally movably disposed in each cylinder hole, and a swash plate facing the cylinder block, an improvement comprising;

the swash plate having a groove of a partly spherical cross section, and each plunger having a partly spherical tip end engaging said groove, said partly spherical tip end of each of said plungers having a radius $R_0$ of curvature, said groove having a depth E, and a ratio of said depth E to said radius $R_0$ of curvature being in the range of $0.36 \leqq E/R_0 \leqq 0.42$.

* * * * *

UNITED STATES PATENT AND TRADEMARK OFFICE

CERTIFICATE OF CORRECTION

PATENT NO. : 5,554,009
DATED : September 10, 1996
INVENTOR(S) : Ohta et al.

It is certified that error appears in the above-indentified patent and that said Letters Patent is hereby corrected as shown below:

Column 8, line 52 (claim 3), delete "platte" and insert -- plate --.

Signed and Sealed this

Twenty-ninth Day of July, 1997

Bruce Lehman

*Attest:*

BRUCE LEHMAN

*Attesting Officer*

*Commissioner of Patents and Trademarks*